United States Patent [19]

Saalasti

[11] Patent Number: 4,673,013

[45] Date of Patent: Jun. 16, 1987

[54] WOODROOM EFFLUENT TREATMENT SYSTEM

[76] Inventor: Timo T. Saalasti, Kelohongantie 9 A 53, 02120 Espoo, Finland

[21] Appl. No.: 784,259

[22] Filed: Oct. 3, 1985

[30] Foreign Application Priority Data

Mar. 7, 1984 [FI] Finland ..... 840940

[51] Int. Cl.[4] ..... B27L 1/00

[52] U.S. Cl. ..... 144/341; 144/208 B; 144/340; 210/251; 210/400

[58] Field of Search ..... 144/208 R, 208 B, 208 D, 144/340, 341, 342, 364, 380; 210/173, 809, 251, 400

[56] References Cited

U.S. PATENT DOCUMENTS

| | | | |
|---|---|---|---|
| 2,038,658 | 4/1936 | Karlstrom | 144/208 B |
| 2,083,445 | 6/1937 | Hellorg et al. | 144/208 B |
| 4,432,403 | 2/1984 | Heikkinen | 144/208 B |

FOREIGN PATENT DOCUMENTS

| | | | |
|---|---|---|---|
| 548580 | 10/1959 | Canada | 144/340 |
| 67181 | 10/1984 | Finland . | |

*Primary Examiner*—W. D. Bray

*Attorney, Agent, or Firm*—Browdy and Neimark

[57] ABSTRACT

Effluent treatment for the woodrooms of wood processing industries, e.g. paper and pulp mills, wherein the water separated from the bark and containing fibres is passed back onto an existing conveyor of wet bark, provided with a perforated bottom, so that some of the fibre contained in the water is filtered and mixed with the bark and passes along with the bark to dewatering.

9 Claims, 2 Drawing Figures

WOODROOM EFFLUENT TREATMENT SYSTEM

BACKGROUND OF THE INVENTION

With an increase in population and with increasing industrialization of the world, protection of environment and waters is becoming ever more important. In several countries, such as Finland, Soviet Union and Canada, the wood-processing industry is the biggest polluter of the waters.

The present invention is in particular concerned with a development of the effluent treatment of the woodrooms of large paper and pulp mills so that the circulating water in the woodroom can be made to remain clean, even so clean that the woodroom can be kept in a closed water circulation. To-day, a large pulp mill, e.g. one that produces 400,000 tons of pulp per year, uses about 2.4 million cubic meters solid measure of wood per year. The woodroom uses clean water as a quantity of about 1 cubic meter per cubic meter solid measure of barked wood, i.e. 2.4 million cubic meters of clean water per year. This quantity of water, which contains about 1.5 kg of organic fibre per cubic meter, is passed to the clarification plant of the mill.

The woodroom yields annually about 3,500 tons of organic fibre in the effluent of the woodroom, i.e. about 1.8 to 2.0 percent of the total weight quantity of the wood used.

In the following, a woodroom provided with a barking drum will be described by way of example. The woodroom and its water circulation system are shown schematically, viewed from the side of the barking drum, in FIG. 1.

Having been washed by means of jets 3 of circulating water, the wood 2 to be barked passes into the barking drum 1 for barking. The barked white wood 4 comes out of the drum and is washed with a jet 5 of clean water. Underneath the drum, there is a flight conveyor 6 with perforated bottom, the circulating water 7 flowing through the perforated bottom of the said conveyor into the circulating water channel 8. The bark 9 that comes out of the slots in the drum 1 remains on the perforated bottom of the flight conveyor 6 and is carried by the flight conveyor into the shredder 10. In the drum 1, some of the bark is ground to fine powder and to thin fibres, which pass along with the circulating water 7 into the channel 8.

The bark coming from the shredder is again carried by the flight conveyor 11 up and fed into the bark dewatering press 12, from which the conveyor 13 carries the dewatered bark further for combustion. Water that contains bark dregs flows into the channel 8 from underneath the conveyor 11 through the perforated bottom, flow 14, and to a greater extent from underneath the bark press, bark water flow 15. The largest flow into the channel is the circulating-water flow 16.

The barking drum, the shredder, and the bark press, from which the circulating water comes, are mounted on the floor level A of the woodroom so that the waters coming from all of these units flow into the same channel 8, from which the water flows into the water clarification equipment of the woodroom and into the water clarification plant of the factory.

In the barking methods commonly used today—half-wet barking drum and lopped paper or pulp wood—the yield of bark is about 0.3 cubic meters loose measure of bark per cubic meter solid measure of barked wood.

Owing to the high cost of the work taking place in the forest, in several places attempts are made to bring the trees with their branches and needles or leaves to the factory for barking. This barking of complete trees increases the quantity of bark, depending on the proportion of branches on the trees. In Canada, the quantity of bark and various branch dregs obtained has been 1 cubic meter loose measure per cubic meter solid measure of barked wood. In particular, the proportion of small particles and fibres ground from twigs, leaves and needles is increased.

Thus, the barking of complete trees makes the proportion of small particles in the bark 2-fold or 3-fold as compared with the present system. This constitutes the greatest drawback of these woodrooms and of their effluent treatment.

By means of the simple method in accordance with the present invention, it is possible to reduce the quantity of these small fibres ending up in the circulating water to an essential extent.

In terms of the need for protection of water resources, the invention is valuable. The invention is also valuable for the industry, because it does not cause high costs.

The invention is characterized in the procedure disclosed in the main claim.

In the following description and in FIG. 2, an embodiment of the invention will be illustrated, without in any way confining the invention to this particular embodiment.

DESCRIPTION OF PREFERRED EMBODIMENT

Figure 1:
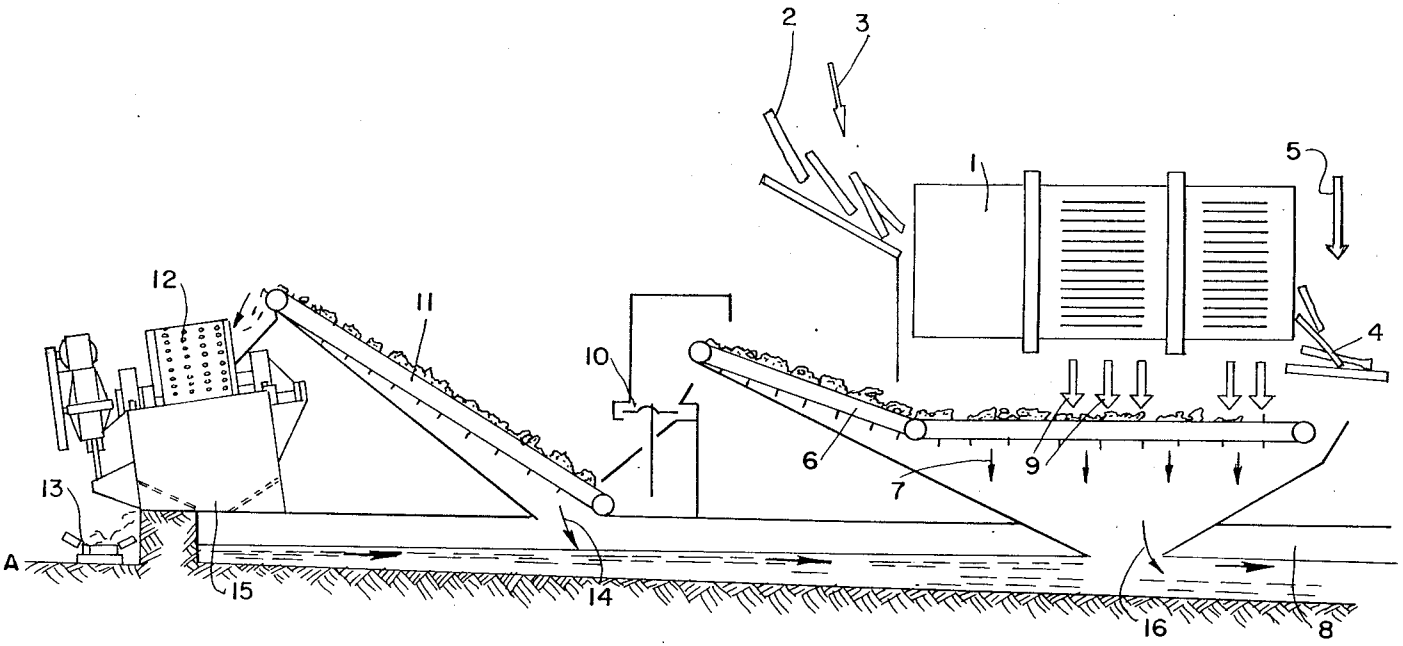
FIG. 1 PRIOR ART
FIG. 1 shows a prior art arrangement for debarking and dewatering.
Figure 2:
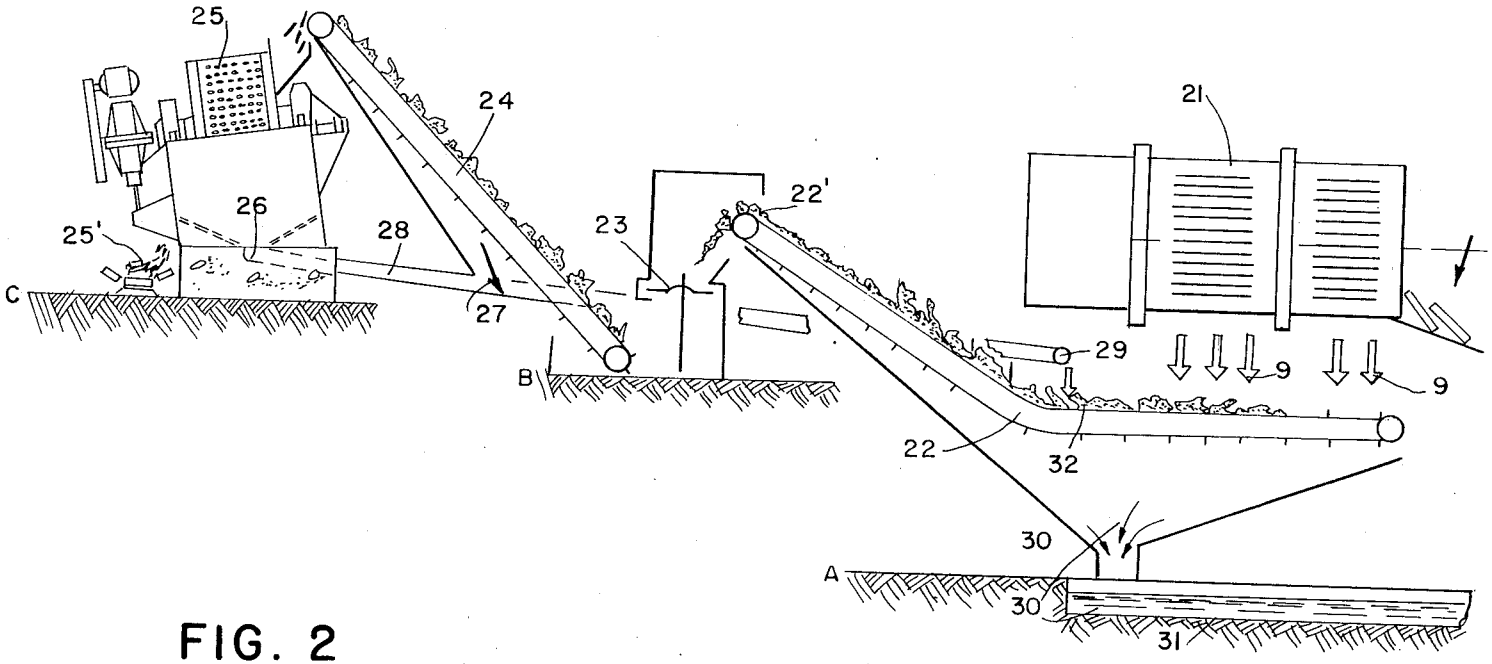
FIG. 2 shows the woodroom effluent treatment system modified in accordance with the invention, schematically as viewed from the side of the barking drum.

The barking drum with its equipment 21 is similar to that shown in FIG. 1. It is placed on the floor level A of the woodroom. Underneath the drum, there is a conventional flight conveyor 22 with perforated bottom. The final end 22' of the flight conveyor, however, rises to a level higher than the end of the conveyor shown in FIG. 1.

The shredder 23 is mounted on a higher level B, and the bark press 25 is mounted on an even still higher foundation C.

The bark 9 and the bark water 9 fall through the slots in the barking drum onto the conveyor 22, which lifts the bark up to the position 22', from where the bark falls into the shredder. The conveyor 24 with perforated bottom lifts the bark into the bark press 25.

The bark water 26 coming from underneath the bark press and the shredder water 27 departing from the bark after the shredder flow into the pipe 28, which passes the waters through the openings 29 underneath the drum onto the bark 32 placed on the flight conveyor 22. Most of the fibres in the waters 26 and 27 that contain bark are filtered in the bark 32 and pass along with the bark into the bark press and, upon dewatering, on the conveyor 25' to combustion. The circulating water 30 flows along the channel 31 to the water clarification equipment of the woodroom, and it is now clearer, because most of the solid materials in the bark waters 26 and shredder waters 27 have remained, on filtration, among the bark 32 passing into the bark press.

Of course, instead of a pipe 28, it is possible to use pumps which pump the shredder waters 27 and the bark waters 26 onto the flight conveyor 22 with perforated bottom, and in this way a clearer circulation water 30 is also obtained, but waters that contain fibres and sand abrade the pumps.

If this circulating water 30 is treated in accordance with the Finnish Patent No. 67,181 concerning a "Procedure and equipment for the separation of solids, such as fibres, dregs or sludge, from water for utilization", the woodroom can be operated without fresh water, i.e. the woodroom is brought into a closed circulation of water and the woodroom effluents need not be passed to the clarification plant at all. Thus, e.g., the waste waters passing to the clarification plant of a paper mill, which consume oxygen, are reduced by about $\frac{1}{3}$, or the annual quantity of 3,500 tons of waste fibre, mentioned above on page 1, is not passed at all to the water clarification plant of the said pulp mill producing 400,000 tons of pulp per year!

What is claimed is:

1. A method for treating effluent from a debarking system comprising:

passing the effluent onto a conveyor having a perforated bottom, the conveyor containing wet bark, and filtering out the fibers contained in the effluent onto the bark.

2. The method of claim 1 comprising passing the fibers filtered out onto the bark on said conveyor along with said bark to a dewatering process.

3. The method of claim 1, comprising a step of shredding said bark while separating water therefrom; and a subsequent step of separating additional water from the shredded bark on a bark press;

wherein the water from each of said steps is passed as said effluent onto said conveyor with said perforated bottom, and said conveyor is placed underneath a barking drum from which said bark originates.

4. The method of claim 2, comprising a step of shredding said bark with said fibers filtered thereon with a bark shredder and separating water therefrom; and a subsequent step of separating additional water from the shredded bark on a bark press;

wherein the water from each of said steps is passed as said effluent onto said conveyor with said perforated bottom, said conveyor being placed underneath a barking drum from which said bark originates.

5. The method of claim 1 wherein a bark shredder and a bark press are placed at such a level that water from the bark treated therein flows by its own weight onto the bark on the bark conveyor.

6. The method of claim 2, comprising flowing said water from a bark shredder for said shredding of said bark and from said bark press by its own weight onto said bark on said conveyor.

7. The method of claim 4, comprising flowing said water from said bark shredder and said bark press by its own weight onto said bark on said conveyor.

8. The method of claim 1 wherein complete trees are barked, water containing a large quantity of solid material, leaves, and needles is mixed with water from the bark press and from the shredder, and these waters are filtered by passing them through the wet bark on a flight conveyor having a perforated bottom.

9. A method of barking wood comprising passing the wood into a barking drum for barking, washing the barked wood with clean water, removing the bark onto a flight conveyor having a perforated bottom, carrying the bark on the flight conveyor into a shredder, carrying the bark from the shredder into a bark dewatering press;

wherein water separated by the shredder and by the press from the wet bark are passed onto the bark on the flight conveyor for filtration of fibers from the water.

* * * * *